United States Patent [19]

Herbstman et al.

[11] 4,321,062

[45] Mar. 23, 1982

[54] HYDROCARBYL SUBSTITUTED PHENYLASPARTATES OF N-PRIMARY-ALKYL-ALKYLENE DIAMINES AND MOTOR FUEL COMPOSITION CONTAINING SAME

[75] Inventors: Sheldon Herbstman, Spring Valley; Peter Dorn, Lagrangeville, both of N.Y.

[73] Assignee: Texaco Inc., White Plains, N.Y.

[21] Appl. No.: 224,413

[22] Filed: Jan. 12, 1981

[51] Int. Cl.[3] ..... C10L 1/22

[52] U.S. Cl. ..... 44/71; 44/DIG. 1; 252/392; 252/393; 560/145

[58] Field of Search ..... 560/145; 44/71, DIG. 1; 252/392, 393

[56] References Cited

U.S. PATENT DOCUMENTS

| | | | |
|---|---|---|---|
| 3,944,397 | 3/1976 | Gardiner et al. | 44/DIG. 1 |
| 3,980,448 | 9/1976 | Haemmerle et al. | 44/DIG. 1 |
| 4,144,036 | 3/1979 | Dummings | 44/71 |
| 4,197,409 | 4/1980 | Lilburn | 44/71 |
| 4,207,079 | 6/1980 | Herbstman et al. | 44/71 |
| 4,231,758 | 11/1980 | Kablaoui | 44/71 |
| 4,274,837 | 6/1981 | Lilburn | 44/71 |

*Primary Examiner*—Winston A. Douglas

*Assistant Examiner*—Y. Harris-Smith

*Attorney, Agent, or Firm*—Carl G. Ries; Robert A. Kulason; Henry W. Archer

[57] ABSTRACT

Hydrocarbyl-substituted phenylaspartates of N-primary-alkyl-alkylene diamines of the formulas:

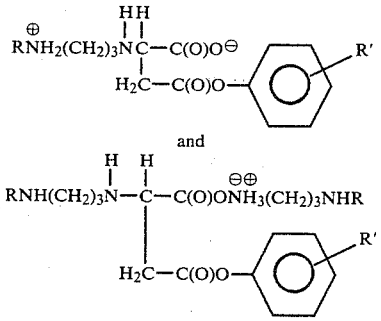

wherein R is a hydrocarbyl radical having from about 6 to 30 carbon atoms; R′ is an alkyl or an alkenyl group having from 6 to 30 carbon atoms are provided together with a motor fuel composition containing at least one of the foregoing compounds.

16 Claims, No Drawings

HYDROCARBYL SUBSTITUTED PHENYLASPARTATES OF N-PRIMARY-ALKYL-ALKYLENE DIAMINES AND MOTOR FUEL COMPOSITION CONTAINING SAME

BACKGROUND OF THE INVENTION

1. Field of the Invention

This invention relates to novel compounds having utility as carburetor detergents, antirust and anti-icing agents in motor fuels.

As is well-known, motor fuels are highly refined products but despite such refining they still contain minor amounts of impurities and water which can cause corrosion in the fuel tank, fuel lines and carburetor of a motor vehicle. In cold latitudes, water in the fuel can form ice and thereby interfere with proper operation of a vehicle. Accordingly, commercial motor fuel compositions contain corrosion inhibitors, antirust agents and where needed, anti-icing agents. Naturally, the economics of providing such fuel are improved if a single multipurpose additive can provide these functions.

2. Description of the Prior Art

Certain N-alkyl-alkylene diamine compounds, as represented by N-oleyl-1,3-diaminopropane, are known to give carburetor detergency properties to gasoline. These additives, however, do not impart corrosion inhibiting or deicing properties to gasoline. As a result, a motor fuel containing only an N-alkyl-alkylene diamine must be modified or formulated with an additional additive in order to have the necessary corrosion inhibiting properties for marketability.

U.S. Pat. No. 3,773,479 discloses a motor fuel composition containing an alkyl-substituted asparagine having the formula:

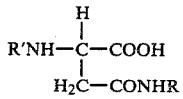

in which R and R' each represent secondary or tertiary alkyl radicals having from 7 to 20 carbon atoms. The corresponding compounds in which R and R' are straight chain radicals are too insoluble in gasoline to be effective as additives.

Coassigned U.S. Pat. No. 4,207,079 describes primary alkyl-alkylene-substituted asparagines produced by reacting about two moles of an N-primary alkyl-alkylene diamine with a mole of maleic anhydride to produce a compound characterized by having a plurality of amino groups in an essentially straight chain primary alkyl hydrocarbon radical which exhibit corrosion inhibiting properties and carburetor detergency properties when employed in gasoline.

The present compounds constitute an improvement thereover in that they deliver equivalent detergency and antirust properties at material costs which are up to 50 percent less and additionally impart deicing properties to the fuels.

SUMMARY OF THE INVENTION

The hydrocarbyl substituted phenylaspartates of N-primary alkyl-alkylene diamines of the invention are represented by the formulas:

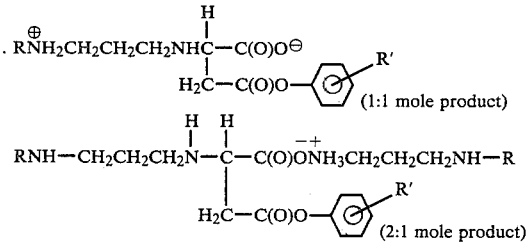

where R is a straght chain primary alkyl aliphatic hydrocarbon radical having about 6 to 30 carbon atoms and R' is an alkyl or alkenyl group having from about 6 to 30 carbon atoms.

The compounds are prepared according to the following reactions:

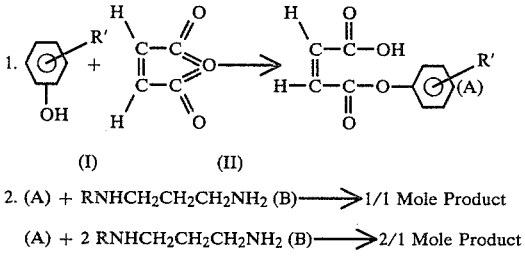

The amine reactant (B) is available commercially under the trade name of "Duomeen" (Armak Company). Certain "Duomeens" are sold in the form of mixtures where the alkyl group has different chain length distributions. Such mixtures can be used as starting materials.

The compounds of the invention can be prepared by several methods.

In one, the 1/1 mole product is prepared by heating to 100° C. maleic anhydride (II) in a mineral oil to form a suspension; adding an equimolar amount of the phenol (I) to the hot suspension and then adding the amine (B) slowly over a period of one half to one hour and maintaining a temperature of 100° C. for two additional hours.

In an improved method, the phenol (I) is first dissolved in oil and an equimolar amount of the amine (B) is added over one half to one hour at 125° C. Next an equimolar amount of maleic anhydride is added at 125° C. and the mixture is heated to 100° C. for at least one hour.

To prepare the 2/1 reaction product, one mole of the phenol is dissolved in oil. Two moles of the amine (B) are added at room temperature and the reaction mixture is heated to 125° C. for one hour. Then one mole of maleic anhydride (II) is added. The reaction mixture is heated at 125° C. for another half hour before filtering off the product.

The preferred N-alkyl-alkylene diamines used are represented by the formula:

$$R—NH—CH_2CH_2—CH_2—NH_2$$

in which R is a straight chain primary alkyl aliphatic hydrocarbon radical having from 6 to 30 carbon atoms, most preferably 16 to 20 carbon atoms.

Examples of suitable N-alkyl-alkylene diamines include N-1-(oleyl)1,3-propane diamine, N-1(lauryl)1,3 propane diamine, N-1(stearyl)1,3 propane diamine and N-1(dodecyl)1,3-propane diamine.

Examples of specific compounds of the invention produced in this reaction which are effective as multifunctional gasoline additives include the following:

| R | R' | Compound Name |
|---|---|---|
| Oleyl | Nonyl ($C_9$) | N-(2-n-Oleylamino-1-propyl)-p-nonylphenyl aspartate. |
| Oleyl | Dodecyl($C_{12}$) | N-(3-n-dodecylamimo-1-propyl)-p-dodecylphenyl aspartate |
| dodecyl | Nonyl | N-(3-n-dodecylamino-1-propyl)-p-nonylphenyl-aspartate |
| stearyl | isodecyl | N-(3-n-stearylamino-1-propyl)-p-isodecylphenyl aspartate |
| Behenyl ($C_{22}$) | Nonyl | N-(3-n-behenylamino-1-propyl)-p-nonylphenyl aspartate |
| Octyl | behenyl | N-(3-n-octylamino-1-propyl)-p-behenyl phenyl aspartate |
| Oleyl | isodecyl | N-(3-n-oleylamino-1-propyl)-p-isodecyl phenylaspartate |
| Oleyl | isononyl | N-(3-n-oleylamino-1-propyl)-p-isononyl phenyl aspartate |

It will be appreciated that by-products and/or impurities can be co-produced along with the compound or mixture of compounds of the invention in this reaction. The desired additive compounds can be readily recovered from the reaction product by known methods. However, it is feasible and economical to employ the present compounds as produced without separation or purification.

The following examples illustrate methods for preparing the additive of the invention:

EXAMPLE 1

This example illustrates the preparation of a 1/1 mole product which is 50% active in oil.

23.7 (0.237 mole) grams of maleic acid was suspended in 252 grams of oil and heated to 100° C. To this suspension was added 70 grams (0.241 mole) of nonylphenol. The reaction mixture was maintained at 100° C. for 3 hr. 150 g of n-oleyl-1,3-propanediamine (Duomeen-OL, 0.24 mole) was added dropwise over 0.5 hr. The reaction mixture was maintained at this temperature for two additional hours. The crude reaction product was then filtered free of any insolubles.

The product gave the following analysis: Total Acid No (TAN)-19.8, N-2.1%. Total Base No (TBN)-29.7 Infrared-Ester carbonyl at 1700-1720 cm.$^{-1}$

EXAMPLE II

This example shows an improved modification of the procedure of Example I.

Nonylphenol (70 gr., 0.241 mole) was dissolved in 252 gr of oil. 158 g of N-oleyl-1,3-propanediamine (Duomeen-OL, 0.24 mole) was added, and the blend heated to 125° C. slowly over 0.5 hr. At 125° C., maleic anhydride (23.7 g, 0.237 mole) was introduced and the reaction heated at 100° C. with stirring an additional hr. The reaction product was then filtered.

EXAMPLE III

This example shows the preparation of the 2/1 reaction product.

22 grams of nonylphenol were introduced to 190 grams of oil. At room temperature with stirring, 70 grams of N-oleyl-1,3-propanediamine were added. The blend was heated to 125° C. and maintained at this temperature for 1 hour. 9.8 grams of maleic anhydride were introduced. The reaction mixture was heated at 125° C. with stirring an additional 0.5 hr. The reaction was filtered hot.

The reaction product contained 34.9% active material. Analytical results.

N-1.6, TAN-9.85, TBN-62.9

Infrared-Ester carbonyl at 1720 cm.$^{-1}$

The base fuel in which the additive of the invention is used is a mixture of hydrocarbons boiling in the gasoline boiling range. This base fuel may consist of straight-chain or branched-chain paraffins, cycloparaffins, olefins, and aromatic hydrocarbons, and any mixture of these. The base fuel can be derived from straight-run naphtha, polymer gasoline, natural gasoline or from catalytically reformed stocks and boils in the range from about 80° to 450° F. The composition and the octane level of the base fuel are not critical and any conventional motor fuel base boiling in the gasoline range can be employed in the practice of this invention.

In general, the additive of the invention is added to the base fuel in a minor amount, i.e., an amount effective to provide corrosion inhibition, deicing properties and carburetor detergency to the fuel composition. The additive is effective in an amount ranging from about 0.0002 to 0.2 weight percent based on the total fuel composition. An amount of the neat additive ranging from about 0.001 to 0.01 weight percent is preferred, with an amount from about 0.001 to 0.003 being particularly preferred, the latter amounts corresponding to about 3 to 8 PTB (pounds of additive per 1000 barrels of gasoline) respectively.

The fuel composition of the invention may contain any of the additives normally employed in a motor fuel. For example, the base fuel may be blended with an anti-knock compound, such as a methyl-cyclopentadienyl manganese tricarbonyl or tetraalkyl lead compound, including tetraethyl lead, tetramethyl lead, tetrabutyl lead, and chemical and physical mixtures thereof, generally in a concentration from about 0.025 to 4.0 cc. per gallon of gasoline. The tetraethyl lead mixture commercially available for automotive use contains an ethylene chloride-ethylene bromide mixture as a scavenger for removing lead from the combustion chamber in the form of a volatile lead halide.

Gasoline blends were prepared from a typical base fuel mixed with specified amounts of the prescribed fuel additive of the invention. These fuels were then tested to determine the effectiveness of the additive in gasoline together with comparison fuels in the following performance tests.

The base fuel employed with the additive of the invention in the following examples was an unleaded grade gasoline having a Research Octane Number of about 93. This gasoline consisted of about 32 percent aromatic hydrocarbons, 8 percent olefinic hydrocarbons and 60 percent paraffinic hydrocarbons and boiled in the range from 88° F. to 373° F.

The rust inhibiting properties of fuel compositions of the invention were determined in the NACE Test (National Association of Corrosion Engineers) which is a modification of ASTM Rust Test D-665-60 Procedure A. In the NACE Test, a steel spindle is polished with non-waterproof fine emery cloth. The spindle is immersed in a mixture containing 300 cc fuel and 30 cc distilled water and is rotated at 100° F. for 3.5 hours. The spindle is then rated visually to determine the amount of rust formation. A passing result is an average of less than 5% rust.

The results of the NACE Test are reported in Table I. The foregoing data show that the novel reaction product of the invention was highly effective as a corrosion inhibitor in the NACE Test even at the lowest concentration of 2.5 PTB. This result is in marked contrast with the failure of the N-oleyl-1,3,propanediamine. The results are equivalent to those obtained with the more expensive product (3) of U.S. Pat. No. 4,207,079 with reference fuel B.

The additives of the invention were tested as carburetor detergents in the Chevrolet Carburetor Detergency Test. This test is run on a Chevrolet V-8 engine mounted on a test stand using a modified four barrel carburetor. The two secondary barrels of the carburetor are sealed and the feed to each of the primary barrels arranged so that an additive fuel can be run in one barrel and the base fuel run in the other. The primary carburetor barrels were also modified so that they had removable aluminum inserts in the throttle plate area in order that deposits formed on the inserts in this area could be conveniently weighed.

In the procedure designed to determine the effectiveness of an additive fuel to remove preformed deposits in the carburetor, the engine is run for a period of time of usually 24 to 48 hours using the base fuel as the feed to both barrels with engine blow-by circulated to an inlet in the carburetor body. The weight of the deposits on both sleeves is determined and recorded. The engine is then cycled for 24 additional hours with a suitable reference fuel being fed to one barrel, additive fuel to the other and blow-by to the inlet in the carburetor body. The inserts are then removed from the carburetor and weighed to determine the difference between the performance of the additive and reference fuels in removing the preformed deposits. After the aluminum inserts are cleaned, they are replaced in the carburetor and the process repeated with the fuels reversed in the carburetor to minimize differences in fuel distribution and barrel construction. The deposit weights in the two runs are averaged and the effectiveness of the fuel composition of the invention is determined by calculating the percent deposit washdown attributed to the fuel with additive. The effectiveness is expressed in percent, the higher the percentage the better the effectiveness. The data obtained in this test are tabulated also in in Table I. The additives of the invention outperformed reference commercial fuel B and were substantially equivalent in performance with that of the more expensive additive (3) of U.S. Pat. No. 4,207,079.

The effect on carburetor detergency of the fuel compositions of the invention was also determined in a second carburetor detergency test, namely, the Buick Carburetor Detergency Test. This test is run on a Buick 350 CID V-8 engine equipped with a two barrel carburetor. The engine is mounted on a test stand and has operating EGR and PCV systems. The test cycle, shown in Table II, is representative of normal road operation. Approximately 300 gallons of fuel and three quarts of oil are required for each run.

Prior to each run, the carburetor is completely reconditioned. Upon completion of the run the throttle plate deposits and the area below the plates (walls) are visually rated according to a CRC Varnish rating scale where 1 describes heavy deposits and 10 completely clean. The ratings for the plates and below plates are averaged.

The Base Fuel employed for testing the additive of the invention was the same unleaded gasoline composition disclosed above. The results of this test are set forth in Table 1. The data show the present additives outperformed the commercial reference fuel and were substantially equivalent to the more expensive additive (3) of U.S. Pat. No. 4,207,079.

TABLE II

1973 BUICK CARBURETOR DETERGENCY TEST OPERATING CONDITIONS

| | Stage I | Stage II | Stage III |
|---|---|---|---|
| Duration, hours | 1 | 3 | 1 |
| Speed, r.p.m. | 650 ± 25 | 1500 ± 25 | 2000 ± 25 |
| Torque, ft.-lbs. | 0 | 80 ± | 108 ± 2 |
| Water Out, °F. | 205 ± 5 | 205 ± 5 | 205 ± 5 |
| Carburetor Air, °F. | 140 ± 5 | 140 ± 5 | 140 ± 5 |
| Exhaust Back Pres. in Hg | — | 0.7 ± 0.1 | — |
| Man. Vac. In Hg | — | 15.8 | 14.2 |
| Fuel Flow, lbs/hr | 0.7 | 7.5 | 12.0 |
| Test Duration, 120 hours | | | |

TABLE I

| Product[a] | R | R[1] | Reactant Mole Ratio | CCDT-III[2,b] % | Buick Detergency 7.5 PTB[1,c] | NACE Rust |
|---|---|---|---|---|---|---|
| 3 | — | — | — | 84–88 | 9.0 | Pass at 2.5 PTB[a] |
| N-oleyl-1,3 propanediamine | — | — | — | — | — | Fail at 20 PTB |
| Aspartate | Oleyl | tetrapropenyl | 1/1 | 76 | 7.5 | Pass at 8 PTB |
| Aspartate | Oleyl | tetrapropenyl | 2/1 | 76 (at 10 PTB) | 8.0 | Pass at 2.5 PTB |
| Aspartate | Oleyl | Nonyl | 1/1 | 82 | 9.1 | Pass at 5 PTB |
| Aspartate[e] | Oleyl | Nonyl | 2/1 | 83 | 8.2 | Pass at 10 PTB |
| Reference Fuel B containing 7.5 PTB of N,N[1]-di($C_{14}$–$C_{20}$ sec alkyl) | | | | 56 | 5.6 | Pass at 5 PTB |

TABLE I-continued

| Product[a] | R | R[1] | Reactant Mole Ratio | CCDT-III[2,b] % | Buick Detergency 7.5 PTB[1,c] | NACE Rust |
|---|---|---|---|---|---|---|
| aspartamide (U.S. Pat. No. 3,773,479) | | | | | | |

[1]All test data reported on Wt. - % active material.
[2]Chevrolet Carburetor Detergency Test
[3]Product of U.S. Pat. No. 4,207,079 prepared from 2M of N-oleyl 1,3 propanediamine and 1 M of maleic anhydride.
[a]50 Wt. - % in either 100E Pale Stock HF or xylenes.
[b]20 PTB active. Percent Deposit Washdown.
[c]Ratings are the average of plates and below plates rating where 1 = dirty and 10 = clean.
[d]Results all indicate a pass with respect to gasoline-water bottoms emulsion properties.
[e]Reaction product contains 34.9 wt - % active material.

The fuel composition of the invention prevents or reduces corrosion problems during the transportation, storage and the final use of the product. The gasoline of the invention also has highly effective carburetor detergency properties. When a gasoline of the invention is employed in a carburetor which already has a substantial build-up of deposits from prior operations, a severe test of the carburetor detergency property of a fuel composition, this motor fuel is effective for removing substantial amounts of the preformed deposits.

It will be evident that the terms and expressions employed herein are used as terms of description and not of limitation. These is no intention, in the use of these descriptive terms and expressions, of excluding equivalents of the features described and it is recognized that various modifications are possible within the scope of the invention claimed.

What we claim is:

1. A compound of the formulas:

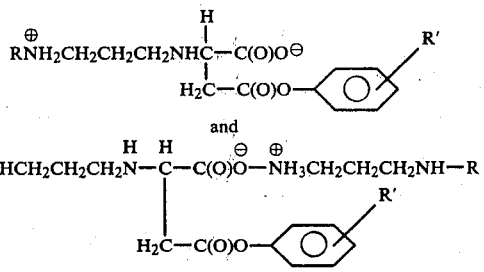

and wherein R is a straight chain primary alkyl aliphatic hydrocarbon radical having from about 6 to 30 carbon atoms and R′ is an alkyl or alkenyl group having from about 6 to about 30 carbon atoms.

2. The compound of claim 1, wherein R ranges from 16 to 20 carbon atoms.

3. The compound of claim 1, wherein R′ is tetrapropenyl.

4. The compound of claim 1, wherein R′ is nonyl and R is alkyl.

5. The compound of claim 1, wherein R is oleyl and R′ is dodecyl.

6. The compound of claim 1, wherein R is dodecyl and R′ is nonyl.

7. The compound of claim 1, wherein R is stearyl and R′ is isodecyl.

8. The compound of claim 1, wherein R is behenyl and R′ is nonyl.

9. The compound of claim 1, wherein R is octyl and R′ is nonyl.

10. The compound of claim 1, wherein R is octyl and R′ is behenyl.

11. The compound of claim 1, wherein R is oleyl and R′ is isodecyl.

12. The compound of claim 1, wherein R is oleyl and R′ is isononyl.

13. A motor fuel composition comprising a mixture of hydrocarbons boiling in the gasoline range and from about 0.0002 to 0.2 weight percent of at least one compound of claim 1.

14. The motor fuel composition of claim 13, wherein said compound has an R substituent having from 16 to 20 carbon atoms.

15. The motor fuel composition of claim 13, wherein R′ is tetrapropenyl.

16. The motor fuel composition of claim 13, wherein R′ is nonyl.

* * * * *